US010892575B1

(12) United States Patent
Komiyama et al.

(10) Patent No.: US 10,892,575 B1
(45) Date of Patent: Jan. 12, 2021

(54) ELECTRONIC COMPONENT, ELECTRONIC DEVICE, AND ELECTRONIC SUBSTRATE

(71) Applicant: LENOVO (SINGAPORE) PTE. LTD., Singapore (SG)

(72) Inventors: Hirohide Komiyama, Yokohama (JP); Jun Kaminaga, Tokyo (JP); Kenji Watamura, Yokohama (JP)

(73) Assignee: LENOVO (SINGAPORE) PTE. LTD., Singapore (SG)

( * ) Notice: Subject to any disclaimer, the term of this patent is extended or adjusted under 35 U.S.C. 154(b) by 0 days.

(21) Appl. No.: 16/718,609

(22) Filed: Dec. 18, 2019

(30) Foreign Application Priority Data

Oct. 25, 2019 (JP) ..... 2019-194231

(51) Int. Cl.
*H01R 12/70* (2011.01)
*H01R 12/71* (2011.01)

(52) U.S. Cl.
CPC ..... *H01R 12/7058* (2013.01); *H01R 12/716* (2013.01)

(58) Field of Classification Search
CPC ..... H01R 12/91; H01R 12/58; H01R 12/716; H01R 12/7058
See application file for complete search history.

(56) References Cited

U.S. PATENT DOCUMENTS 6,333,784 B1 * 12/2001 Blasi ..... G01J 3/44 356/301
7,301,254 B1 * 11/2007 Lal ..... G21H 1/02 310/309
2018/0337482 A1 * 11/2018 Teruki ..... H01R 12/91
2019/0173216 A1 * 6/2019 Sunaga ..... H01R 12/58

FOREIGN PATENT DOCUMENTS

JP 2016012886 A 1/2006

* cited by examiner

*Primary Examiner* — Jean F Duverne
(74) *Attorney, Agent, or Firm* — Shimokaji IP

(57) ABSTRACT

An electronic component includes a first substrate including first connection terminals in an end region on a first surface; and a second substrate including second connection terminals on a first surface, the second connection terminals being disposed at a position corresponding to the first connection terminals. Each of the first connection terminals includes a base and an elastic contact piece extending from the base. The elastic contact piece is elastically deformable in a direction in which the tip end portion thereof approaches and departs with respect to the base. The first connection terminals are electrically connected to the second connection terminals while having the first surface of the first substrate being opposed to the first surface of the second substrate, and the second connection terminals being pressed onto the elastic contact pieces.

8 Claims, 8 Drawing Sheets

ELECTRONIC COMPONENT, ELECTRONIC DEVICE, AND ELECTRONIC SUBSTRATE

FIELD OF THE INVENTION

The present invention relates to an electronic component, an electronic device, and an electronic substrate.

BACKGROUND OF THE INVENTION

An electronic device, such as a laptop personal computer (a laptop PC), may include an electronic component having a main substrate and a sub-substrate connected to the main substrate (refer to Japanese Unexamined Patent Application Publication No. 2006-12886, for example). The two substrates (the main substrate and the sub-substrate) are connected to each other, for example, via a board-to-board connector.

SUMMARY OF THE INVENTION

When it is necessary to flow a large current between two substrates, extension of a board-to-board connector to flow a current through the extended connector is a possibility. However, with extension of a connector, there is a possibility that reliability in connection decreases in any of the plurality of connectors. In view of the above, an electronic component that ensures high reliability in connection between two substrates and allows flowing a large current between substrates has been desired.

According to one aspect of the present invention, it is an object to provide an electronic component, an electronic device, and an electronic substrate that ensure high reliability in connection between two substrates and allow flowing of a large current between the substrates.

According to one aspect of the present invention, there is provided an electronic component including: a first substrate including first connection terminals in an end region on a first surface; and a second substrate including second connection terminals on a first surface, the second connection terminals being disposed at a position corresponding to the first connection terminals, wherein the first connection terminals each include a base and an elastic contact piece extending from the base, the elastic contact piece is elastically deformable in a direction in which the tip end portion thereof approaches and departs with respect to the base, and the first connection terminals are electrically connected to the second connection terminals while having the first surface of the first substrate being opposed to the first surface of the second substrate, and the second connection terminals being pressed onto the elastic contact pieces.

Preferably, the electronic component further includes a locking part on which an end edge portion of the second substrate is locked, the locking part being provided on the first surface of the first substrate, wherein the elastic contact piece in an undeformed state extends, while being inclined, in a direction that departs further away from the first surface of the first substrate as it goes closer to the locking part, and the second connection terminals of the second substrate are pressed onto the elastic contact pieces while having the end edge portion locked on the locking part.

Preferably, the elastic contact piece is connected to each of the second connection terminals of the second substrate while being elastically bent and deformed.

Preferably, the locking part is made of electrically conductive material, and the second substrate includes a ground pad provided on a part thereof, the ground pad being configured to be electrically connected to the locking part.

Preferably, the first connection terminals and the second connection terminals include a terminal for power supply.

Preferably, the first substrate further includes a first board-to-board connector at a position adjacent to the first connection terminals on the first surface, the second substrate further includes a second board-to-board connector at a position adjacent to the second connection terminals on the first surface, and the second board-to-board connector is vertically connected to the first board-to-board connector.

According to another aspect of the present invention, there is provided an electronic device including the electronic component.

According to still another aspect of the present invention, there is provided an electronic substrate including: first connection terminals and a locking part formed on a first surface, the locking part being capable of locking an end edge portion of another substrate, wherein the first connection terminals each include a base and an elastic contact piece extending from the base, and the elastic contact piece is elastically deformable in a direction in which the tip end portion thereof approaches and departs with respect to the base, and the elastic contact piece in an undeformed state extends, while being inclined, in a direction that departs further away from the first surface of the first substrate as it goes closer to the locking part.

According to one aspect of the present invention, there are provided an electronic component, an electronic device, and an electronic substrate that ensure high reliability in connection between two substrates, and allow flowing of a large current between the substrates.

DETAILED DESCRIPTION OF THE INVENTION

[Electronic Device and Electronic Component]

Figure 1:
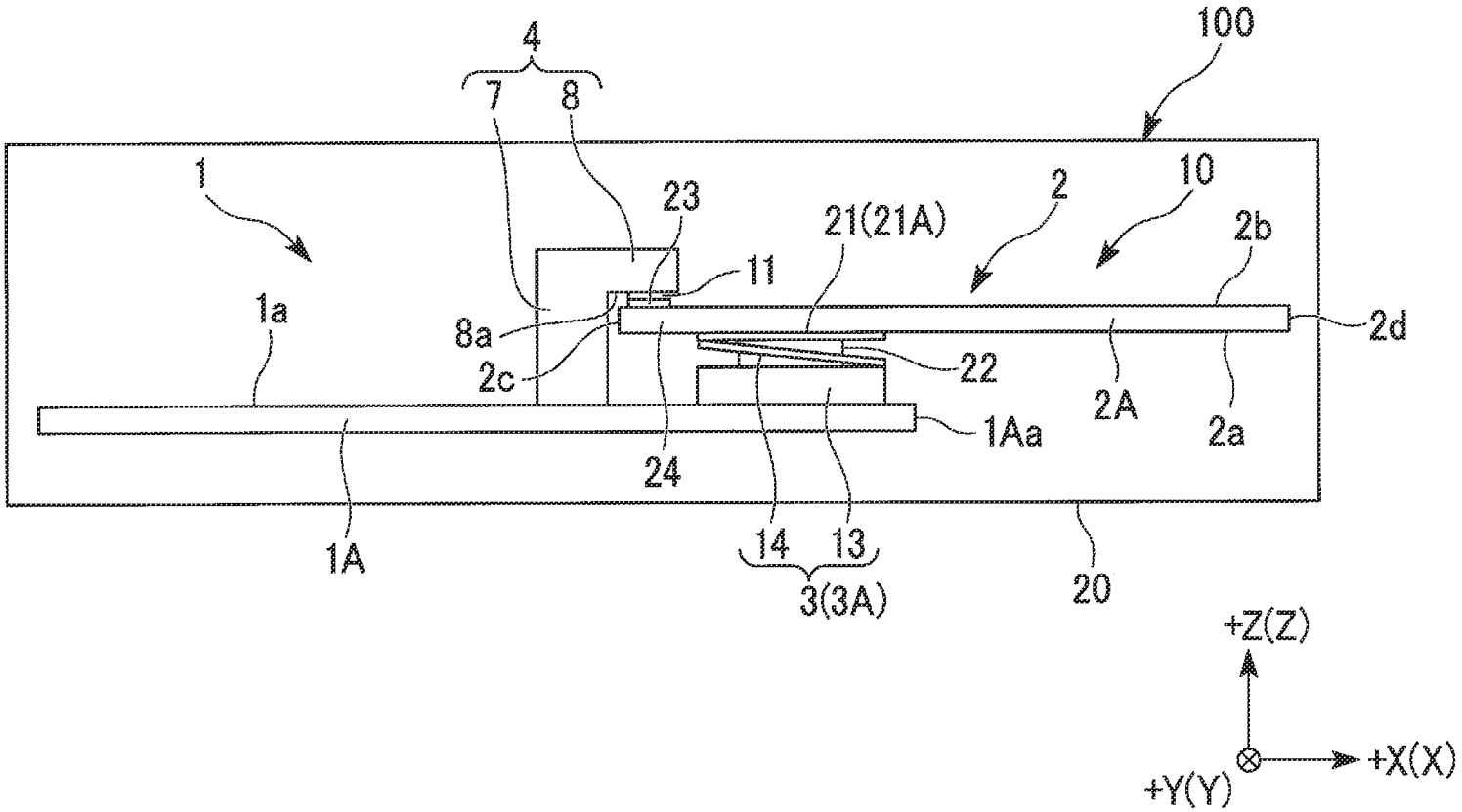
FIG. 1 is a diagram illustrating the structure of an electronic device including an electronic component according to an embodiment.

An electronic device 100 according to an embodiment will be described. As illustrated in FIG. 1, the electronic device 100 includes an electronic component 10 and a chassis 20. The chassis 20 accommodates the electronic component 10.

The electronic device 100 may be, for example, a lap-top personal computer (a laptop PC), a smart phone, a portable phone terminal, a workstation, or a server.

Figure 3:
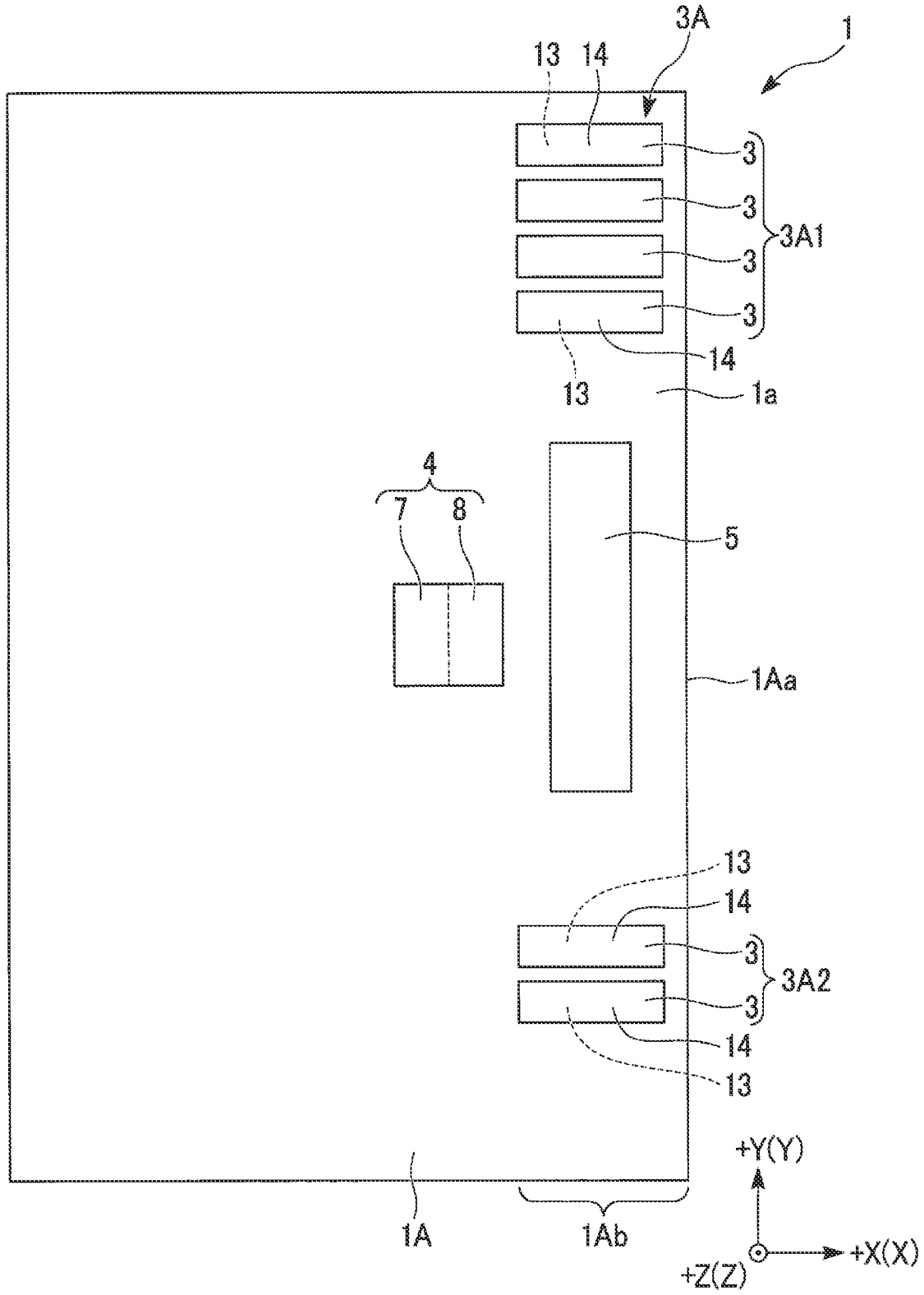
FIG. 3 is a schematic plan view of a main substrate of an electronic component according to an embodiment.

As to the electronic component 10, the positional relationships of respective structures may be described using the XYZ rectangular coordinate system. As illustrated in FIG. 3, the X direction is the front-back direction (a first direction) of a substrate main body 1A. The +X direction is a forward direction. The −X direction is a backward direction. The Y direction is an in-plane direction of the substrate main body 1A, that is a direction (a second direction) orthogonal to the X direction. The dimension in the Y direction may be referred to as a "width". The Z direction is a thickness direction of the substrate main body 1A, or a direction (a third direction) orthogonal to the X direction and the Y direction. The +Z direction is an upward direction. The −Z direction is a downward direction. Viewing in the Z direction (the up-down direction) is referred to as a plan view. The substrate main body 1A is assumed to be shaped like a rectangular plate. The front end edge 1Aa of the substrate main body 1A corresponds to the longer edge of the rectangular substrate main body 1A. The positional relationship defined here does not limit the posture of the electronic device 100 in use.

Figure 2:
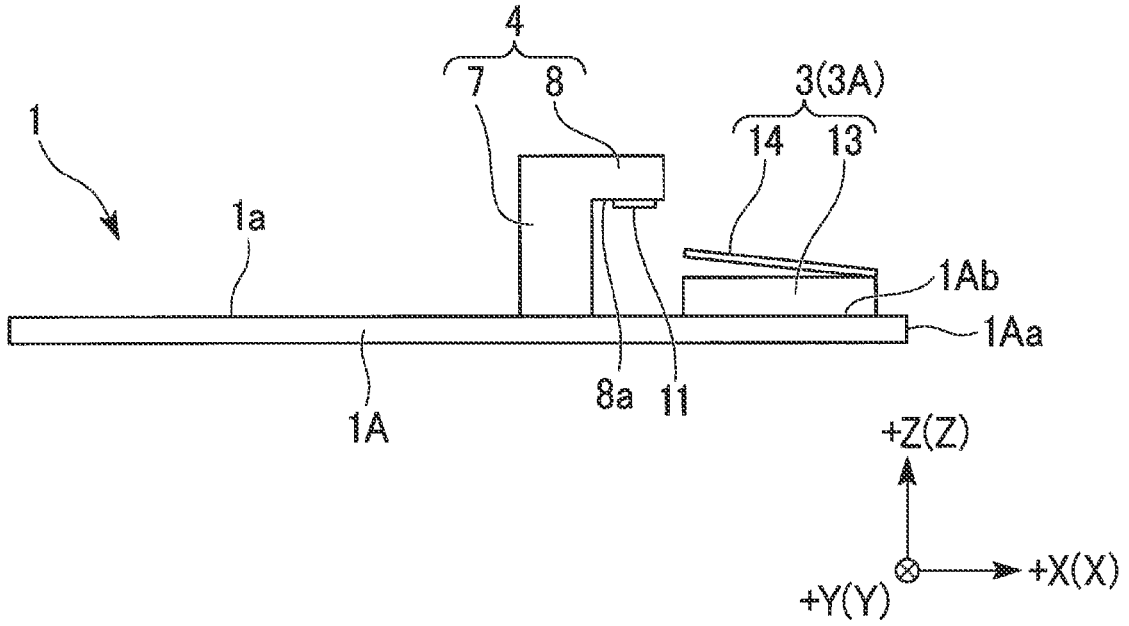
FIG. 2 is a schematic side view of a main substrate of an electronic component according to an embodiment.

As illustrated in FIG. 2, the electronic component 10 includes a main substrate 1 (an electronic substrate) and a sub-substrate 2.

The main substrate 1 includes the substrate main body 1A, first connection terminals 3A, a locking part 4, and a first board-to-board connector 5 (a first substrate-to-substrate connector) (refer to FIG. 3).

The main substrate 1 is one example of a "first substrate". The substrate main body 1A is, for example, a rigid substrate. One surface of the substrate main body 1A is referred to as a mount surface 1*a* (a first surface). As illustrated in FIG. 3, a front end region 1Ab is an end region of the mount surface 1*a* of the substrate main body 1A, the end region containing the front end edge 1Aa. The front end region 1Ab is a band region extending over the entire length in the Y direction.

As illustrated in FIG. 2, the locking part 4 is provided on the mount surface 1*a* of the substrate main body 1A. The locking part 4 includes a base pillar portion 7 and a locking convex portion 8. The locking part 4 is made of electrically conductive material, for example. Examples of electrically conductive material include metals, such as copper, bronze, aluminum, and aluminum alloy.

The base pillar portion 7 stands on the mount surface 1*a*. The base pillar portion 7 extends upward (the +Z direction) from the mount surface 1*a*. The base pillar portion 7 may be shaped like, for example, a rectangular pillar or a plate along the YZ plane.

The locking convex portion 8 projects forward (the +X direction) from the front surface of the upper end portion of the base pillar portion 7. The locking convex portion 8 is a plate along the XY plane, for example. On the lower surface 8*a* of the locking convex portion 8, a connection pad (an electrode pad) is formed (refer to FIG. 2). The connection pad 11 is made of metal, such as copper or bronze. The connection pad 11 is electrically connected to the main substrate 1. The locking convex portion 8 is formed integral to the base pillar portion 7. The width (the dimension in the Y direction) of the locking convex portion 8 is equal to the width of the base pillar portion 7 (refer to FIG. 3).

As illustrated in FIG. 3, the position of the locking part 4 in the Y direction on the main substrate 1 is, for example, at the middle.

The first connection terminals 3A are provided in the front end region 1Ab on the mount surface 1*a* of the main substrate 1.

The first connection terminals 3A include a plurality of (for example, six in FIG. 3) connection terminals 3 (terminals). The plurality of connection terminals 3 are aligned at intervals in the Y direction. In detail, the first connection terminals 3A include connection terminals 3A1 and connection terminals 3A2. The connection terminals 3A1 include a plurality of (for example, four in FIG. 3) connection terminals 3 aligned at intervals in the Y direction. The connection terminals 3A2 are provided spaced apart from the connection terminals 3A1 in the −Y direction. The connection terminals 3A2 include a plurality of (for example, two in FIG. 3) connection terminals 3 aligned at intervals in the Y direction. As illustrated in FIG. 2, the connection terminals 3 are positioned further in the +X direction compared with the locking part 4.

Of the plurality of connection terminals 3, at least one connection terminal 3 may be a connection terminal for power supply. That is, the first connection terminals 3A may include a connection terminal 3 for power supply.

As illustrated in FIG. 3, the connection terminals 3A1 are positioned further in the +Y direction than the locking part 4. The connection terminals 3A2 are positioned further in the −Y direction than the locking part 4.

Figure 4:
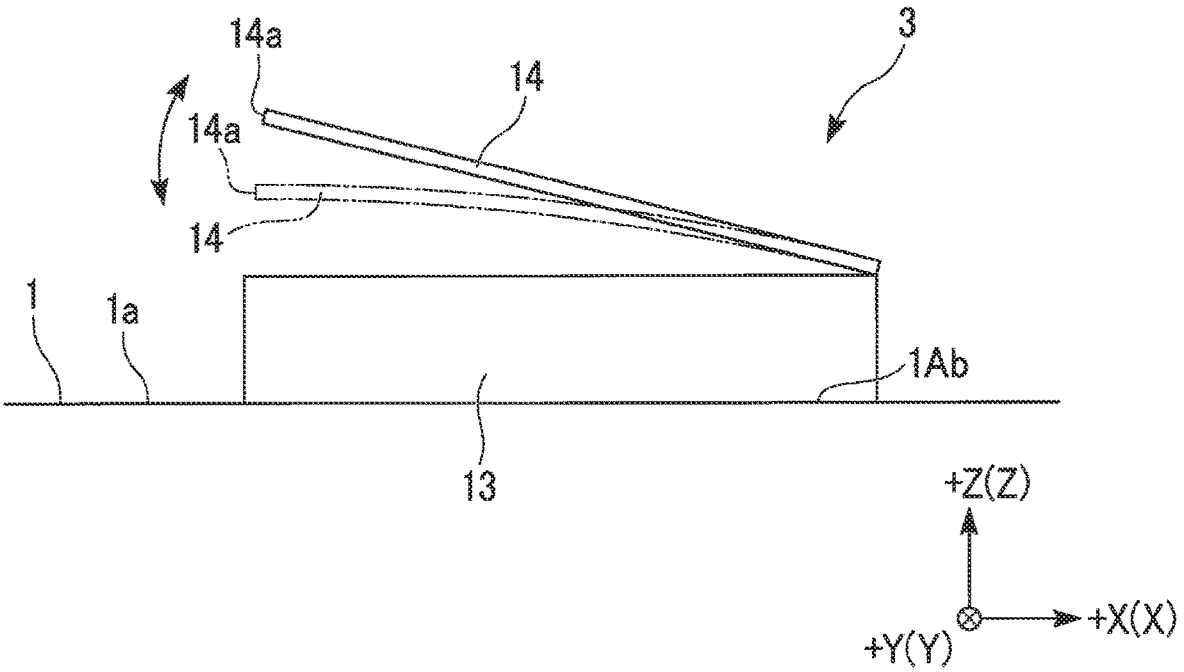
FIG. 4 is a diagram illustrating the structure of a connection terminal of an electronic component according to an embodiment.

As illustrated in FIG. 4, each connection terminal 3 includes a base 13 and an elastic contact piece 14. The connection terminal 3 is made of metal, such as copper or bronze, for example.

The base 13 is provided on the mount surface 1*a*. The base 13 may be a plate along the mount surface 1*a*. As illustrated in FIG. 3, in a plan view, the base 13 may be shaped like a rectangle whose longitudinal direction extends along the front-back direction (the X direction).

As illustrated in FIG. 4, the elastic contact piece 14 is assumed to be an elastically bendable and deformable plate. The elastic contact piece 14 extends from the front end (the tip end in the +X direction) of the base 13. The elastic contact piece 14 may have, for example, a rectangular shape whose longitudinal direction extends along the front-back direction (the X direction) in a plan view. The elastic contact piece 14 in an undeformed state extends, from the front end of the base 13 as a start, in a direction that departs further away from the mount surface 1*a* as it goes closer to the locking part 4 (refer to FIG. 2). That is, the elastic contact piece 14 extends in a direction that goes rearward as it goes upward further away from the mount surface 1*a*.

In FIG. 4, the elastic contact piece 14 in an undeformed state is indicated by a solid line, while an example of the elastic contact piece 14 in an elastically bent and deformed state is indicated by a virtual line. The elastic contact piece 14 is elastically deformable in a direction in which its tip end portion 14*a* approaches and departs with respect to the base 13.

As illustrated in FIG. 3, the first board-to-board connector 5 is positioned close to the front end edge 1Aa, compared with the locking part 4, for example. The first board-to-board connector 5 is positioned further in the −Y direction than the connection terminals 3A1. The first board-to-board connector 5 is positioned further in the +Y direction than the connection terminals 3A2. The first board-to-board connector 5 is positioned adjacent to the connection terminals 3A1 and connection terminals 3A2 in the Y direction (that is, a position adjacent to the first connection terminals 3A).

Figure 5A:
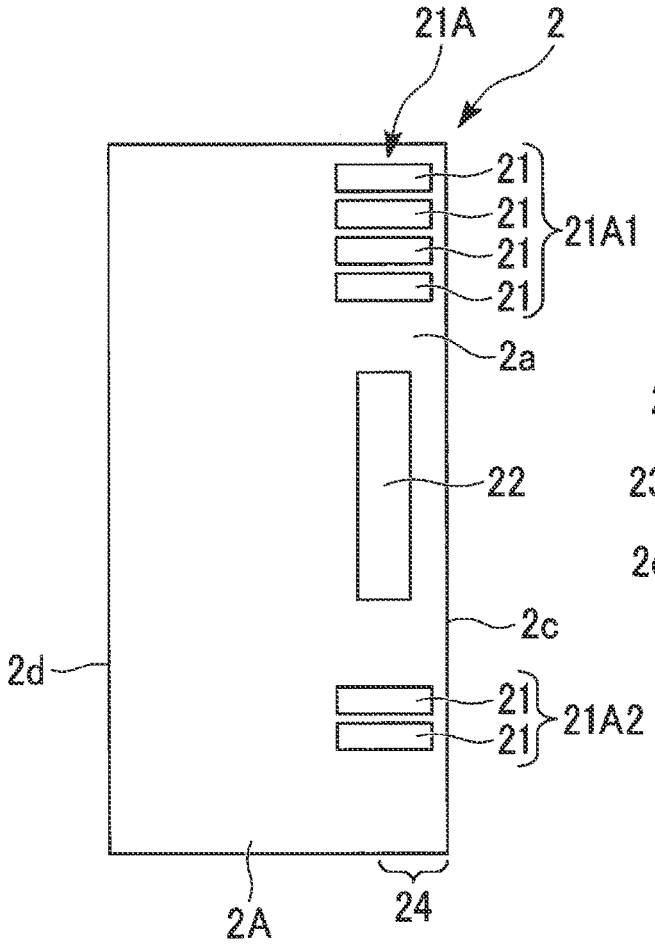
FIG. 5A is a schematic plan view of a first surface of a sub-substrate of an electronic component according to a first embodiment.

The first board-to-board connector 5 is to be connected to the second board-to-board connector 22 of the sub-substrate 2 (refer to FIG. 5A).

The first board-to-board connector 5 and the second board-to-board connector 22 have a function for relatively positioning the main substrate 1 and the sub-substrate 2 on the XY plane. The first board-to-board connector 5 and the second board-to-board connector 22 have a function for connecting a signal line between the main substrate 1 and the sub-substrate 2.

As illustrated in FIG. 1, the sub-substrate 2 includes a substrate main body 2A, second connection terminals 21A, and a second board-to-board connector 22 (a second sub-strate-to-substrate connector) (refer to FIG. 5A). The sub-substrate 2 is one example of a "second substrate". The substrate main body 2A is a rigid substrate, for example. The substrate main body 2A is assumed to be a rectangular plate (refer to FIG. 5A).

The first surface 2*a* of the substrate main body 2A is a surface opposed to the main substrate 1. The second surface 2*b* is a surface opposite from the first surface 2*a*. The rear end edge of the substrate main body 2A is referred to as a first end edge 2*c*. The front end edge of the substrate main body 2A is referred to as a second end edge 2*d*.

As illustrated in FIG. 5A, the second connection terminals 21A are provided on the first surface 2*a* of the substrate main body 2A. The second connection terminals 21A are disposed at a position corresponding to the first connection terminals 3A of the main substrate 1 (refer to FIG. 3).

The second connection terminals 21A include a plurality of (for example, six in FIG. 5A) connection terminals 21 (a terminal, a connection pad, an electrode pad). The plurality of connection terminals 21 are aligned at intervals in the up-down direction in FIG. 5A (or the Y direction in FIG. 1). In detail, the second connection terminals 21A include connection terminals 21A1 and connection terminals 21A2. The connection terminal 21 is made of metal, such as copper or bronze.

The connection terminals 21A1 include a plurality of (for example, four in FIG. 5A) connection terminals 21 aligned at intervals in the Y direction. The connection terminals 21A1 are disposed at a position corresponding to the connection terminals 3A1 (refer to FIG. 3). The connection terminals 21A2 are provided spaced apart from the connection terminals 21A1 in the −Y direction (refer to FIG. 1). The connection terminals 21A2 include a plurality of (for example, two in FIG. 5A) connection terminals 21 aligned at intervals in the Y direction. The connection terminals 21A2 are disposed at a position corresponding to the connection terminals 3A2 (refer to FIG. 3).

At least one of the plurality of connection terminals 21 may be a connection terminal for power supply. That is, the second connection terminals 21A may include a connection terminal 21 for power supply. The connection terminal 21 for power supply among the second connection terminals 21A is connected to the connection terminal 3 for power supply among the first connection terminals 3A. With the above, it is possible to flow a large current between the main substrate 1 and the sub-substrate 2.

The second board-to-board connector 22 is provided at a position corresponding to the first board-to-board connector 5 of the main substrate 1. The second board-to-board connector 22 is positioned further in the −Y direction than the connection terminals 21A1. The second board-to-board connector 22 is positioned further in the +Y direction than the connection terminals 21A2. The second board-to-board connector 22 is disposed at a position adjacent to the connection terminals 21A1, 21A2 in the Y direction (that is, a position adjacent to the second connection terminals 21A).

The second board-to-board connector 22 is vertically connectable to the first board-to-board connector 5.

Figure 5B:
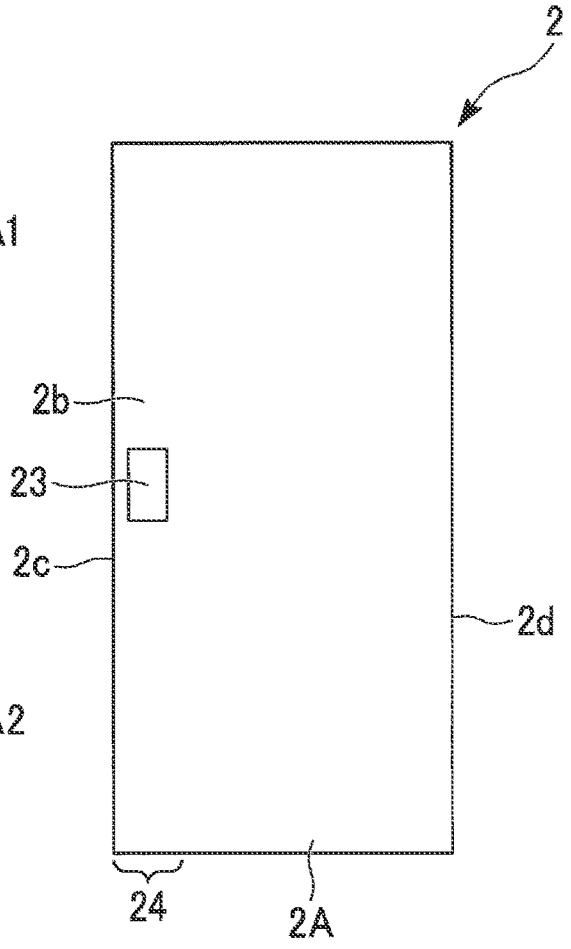
FIG. 5B is a schematic plan view of a second surface of the sub-substrate.

As illustrated in FIG. 5B, on the second surface 2*b* of the sub-substrate 2, a ground pad 23 (an electrode pad) is provided. The ground pad 23 is made of metal, such as copper or bronze. The ground pad 23 is located, for example, on a portion (the end edge portion 24) of the substrate main body 2A, the portion containing the first end edge 2*c*. The end edge portion 24 is a band portion extending over the entire length in the up-down direction in FIG. 5B.

As illustrated in FIG. 1, the end edge portion 24 of the sub-substrate 2 is locked on the locking part 4 (in detail, the locking convex portion 8). The end edge portion 24 is locked on the lower surface 8*a* of the locking convex portion 8 of the locking part 4. The ground pad 23 abuts on the connection pad 11 of the locking convex portion 8 to be electrically connected to the connection pad 11. The ground pad 23 is electrically connected to the locking part 4 via the connection pad 11.

Each connection terminal 21 of the second connection terminals 21A of the sub-substrate 2 is pressed onto the elastic contact piece 14 of the connection terminal 3, while having the end edge portion 24 locked on the locking convex portion 8. As indicated by a virtual line in FIG. 4, the elastic contact piece 14 may be in a state of being elastically bent and deformed. As illustrated in FIG. 1, the connection terminal 21 of the sub-substrate 2 abuts on the elastic contact piece 14, and is electrically connected to the elastic contact piece 14. With the above, the second connection terminals 21A of the sub-substrate 2 are electrically connected to the first connection terminals 3A of the main substrate 1.

The second board-to-board connector 22 of the sub-substrate 2 is fit to the first board-to-board connector 5 of the main substrate 1. The sub-substrate 2 may be parallel to the main substrate 1.

[Method for Assembling Electronic Component]

Figure 6:
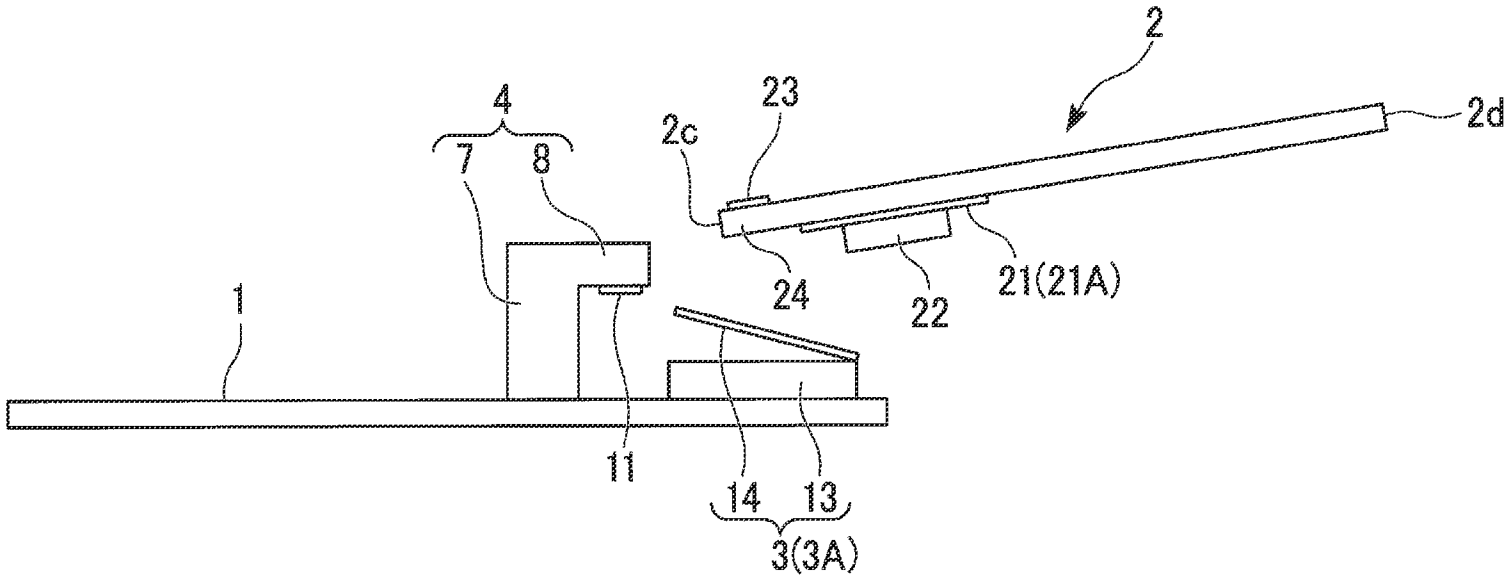
FIG. 6 illustrates processes of assembling an electronic component according to an embodiment.
Figure 7:
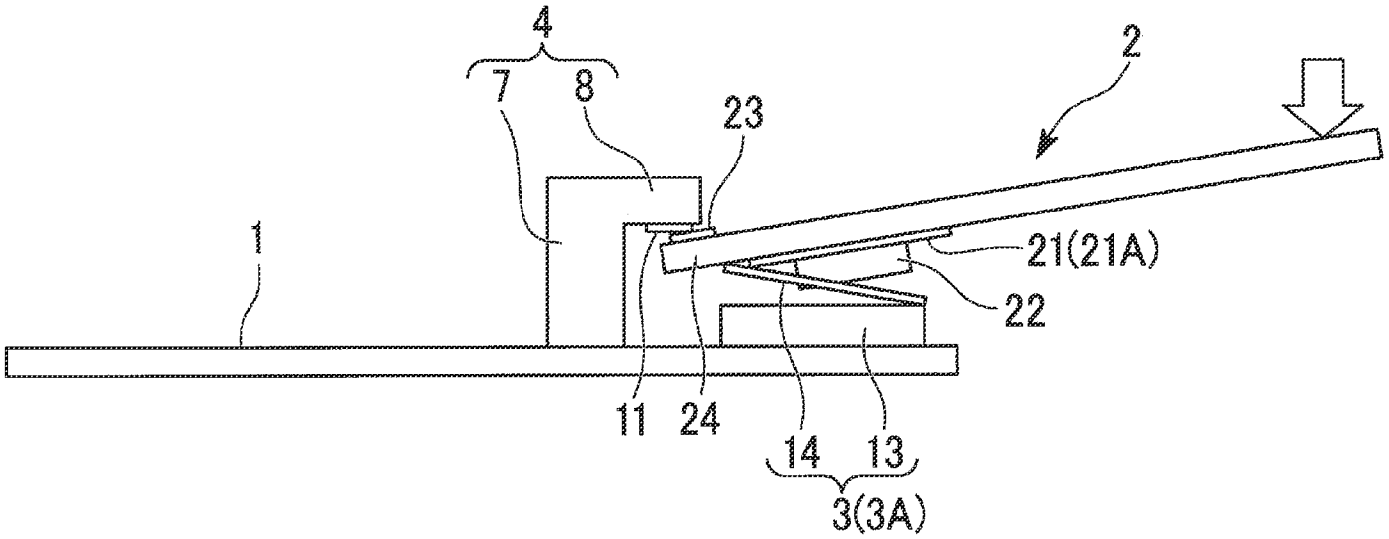
FIG. 7 illustrates subsequent processes of assembling to those in FIG. 6.
Figure 8:
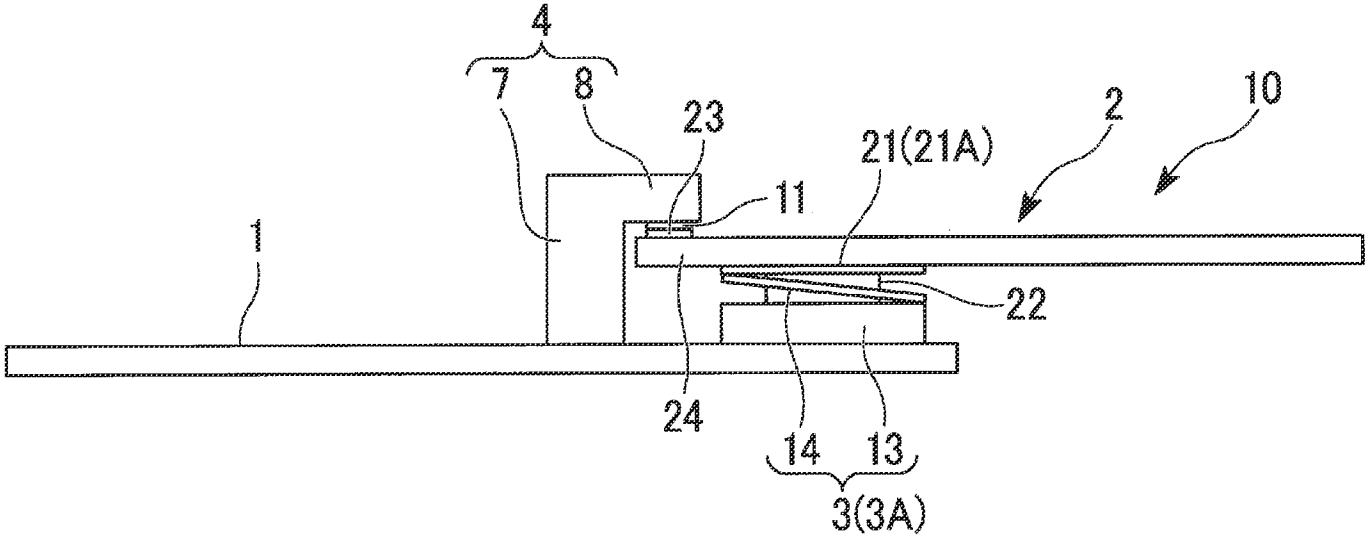
FIG. 8 illustrates subsequent processes of assembling to those in FIG. 7.

Referring to FIG. 6 to FIG. 8, one example of a method for assembling the electronic component 10 will be described.

As illustrated in FIG. 6, the main substrate 1 and the sub-substrate 2 are prepared. The elastic contact piece 14 of the connection terminal 3 is not deformed. The sub-substrate 2 is in a posture in which a part of the first surface 2*a* is opposed to the mount surface 1*a* of the main substrate 1. Preferably, the sub-substrate 2 is in a posture in which the sub-substrate 2 is inclined so as to descend from the second end edge 2*d* toward the first end edge 2*c*.

Then, as illustrated in FIG. 7, the sub-substrate 2 is moved backward while descending until a part of the end edge portion 24 is positioned between the locking convex portion 8 of the locking part 4 and the substrate main body 1A. In the above, the sub-substrate 2 is disposed such that the position of the second connection terminals 21A coincides with the position of the first connection terminals 3A.

Then, as illustrated in FIG. 8, with the portion of the end edge portion 24, the portion abutting on the locking convex portion 8, as a fulcrum, the sub-substrate 2 is rotated downward. The sub-substrate 2 becomes substantially parallel to the main substrate 1. With the above, the connection terminal 21 of the second connection terminals 21A is pressed onto the elastic contact piece 14 of the connection terminal 3. The elastic contact piece 14 abuts on the connection terminal 21, while being elastically bent and deformed. With the above, the second connection terminals 21A of the sub-substrate 2 are electrically connected to the first connection terminals 3A of the main substrate 1.

With the elasticity of the elastic contact piece 14, a force in a push-up direction is applied to the sub-substrate 2. Thus, the ground pad 23 of the sub-substrate 2 is pressed onto the connection pad 11 of the locking part 4 to be electrically connected to the locking part 4 via the connection pad 11.

The second board-to-board connector 22 is connected to the first board-to-board connector 5. With the above, the electronic component 10 is obtained.

With the first connection terminals 3A connected to the second connection terminals 21A, the electronic component 10 can flow a large current between the main substrate 1 and the sub-substrate 2. As the first connection terminals 3A include the elastically deformable elastic contact pieces 14, even when the main substrate 1 and the sub-substrate 2 are not accurately positioned, connection can be ensured. Thus, reliability in connection between the main substrate 1 and the sub-substrate 2 can be enhanced.

The elastic contact piece 14 in an undeformed state is inclined in a direction that departs further away from the mount surface 1*a* as it goes closer to the locking part 4. Thus, in assembling the sub-substrate 2 to the main substrate 1, even if the sub-substrate 2 should touch the elastic contact piece 14 of the connection terminal 3, the movement of the sub-substrate 2 in a direction toward the main substrate 1 is unlikely hindered. Thus, assembling the sub-substrate 2 is unlikely hindered. Also, damage to the connection terminal 3 is avoidable.

As the sub-substrate 2 is pressed onto the elastic contact piece 14 of the connection terminal 3 while having the end edge portion 24 locked on the locking part 4, it is possible to have the second connection terminals 21A of the sub-substrate 2 in a stable posture, connected to the first connection terminals 3A. This facilitates assembling the electronic component 10.

As a formation for comparison, assume an electronic component (not illustrated) including a pogo pin instead of the connection terminal 3. A pogo pin is a movable probe pin whose movable terminal portion is urged in a stick-out direction by a spring. A pogo pin is assumed to have a pillar shape, and stands on the mount surface of the main substrate. With this electronic component, in assembling the sub-substrate to the main substrate, the sub-substrate abuts on a pogo pin and is thereby hindered from moving. Thus, assembling the sub-substrate can be hindered.

The elastic contact piece 14 in a state of being elastically bent and deformed is connected to the second connection terminals 21A of the sub-substrate 2. Thus, the elastic contact piece 14 enables reliable electrical connection relative to the connection terminal 21 of the sub-substrate 2.

When the elastic contact piece 14 in a state of being elastically bent and deformed is connected to the second connection terminals 21A of the sub-substrate 2, a force in a push-up direction is applied to the sub-substrate 2. Thus, the ground pad 23 of the sub-substrate 2 is pressed onto the locking part 4. This enables reliable electrical connection between the ground pad 23 and the locking part 4.

A specific structure of this invention is not limited to the above described embodiment, and, for example, a design in a range not departing from the gist of the present invention is included. The respective structures described in the above embodiment can be arbitrarily combined.

For example, in the connection terminal 3 illustrated in FIG. 4, the elastic contact piece 14 in an undeformed state extends linearly, while being inclined in a direction that departs further away from the mount surface 1*a* as it goes closer to the locking part 4. This, however, is not an exclusive example of the shape of the elastic contact piece. The elastic contact piece can have a structure in which at least a part of the elastic contact piece extends while being inclined in a direction in which the part departs further away from the mount surface as it goes closer to the locking part. For example, only a part of the elastic contact piece in the longitudinal direction may extend while being inclined in a direction in which the part departs further away from the mount surface as it goes closer to the locking part, while the remaining part may not extend in such a direction. The elastic contact piece is not necessarily linear, and may extend curvedly.

The electronic component in the embodiment can include no locking part. In this case, the sub-substrate can be positioned relative to the main substrate, with a positioning structure different from the locking part. For example, the sub-substrate can be positioned relative to the main substrate by means of concave and convex mating or screwing, for example.

Although the connection terminal 3 including the base 13 and the elastic contact piece 14 is provided on the main substrate 1 in the electronic component 10, as illustrated in FIG. 1, a connection terminal including a base and an elastic contact piece may be provided on the sub-substrate. In this case, the connection terminal (a connection pad) on the main substrate is pressed onto the elastic contact piece. In this structure, the main substrate corresponds to the "second substrate", and the sub-substrate corresponds to the "first substrate".

Although the electronic component 10 includes the board-to-board connectors 5, 22 for positioning the main substrate 1 and the sub-substrate 2, an electronic component in this embodiment can have no board-to-board connector. In the case of an electronic component without a board-to-board connector, preferably, the main substrate and the sub-substrate include a mechanism for relatively positioning the main substrate and the sub-substrate on the XY plane.

In the case where the locking part 4 (refer to FIG. 2) is made of electrically conductive material, such as metal, the connection pad 11 is omissible.

The invention claimed is:

1. An electronic component comprising:

a first substrate including first connection terminals in an end region on a first surface of the first substrate; and a second substrate including second connection terminals on a first surface of the second substrate, the second connection terminals being at a position corresponding to the first connection terminals, wherein:

the first connection terminals each include a base and an elastic contact piece extending from the base, the elastic contact piece is elastically deformable in a direction in which a tip end portion thereof moves towards and away from the base, and the first connection terminals are electrically connected to the second connection terminals while the first surface of the first substrate is opposed to the first surface of the second substrate, and the second connection terminals are pressed onto the elastic contact pieces.

2. The electronic component according to claim 1, further comprising:

a locking part locked to an end edge portion of the second substrate, the locking part being on the first surface of the first substrate, wherein:

the elastic contact piece, in an undeformed state, is inclined with respect to the first surface of the first substrate, and at least one of the second connection terminals of the second substrate is pressed onto the elastic contact piece while having the end edge portion locked on the locking part.

3. The electronic component according to claim 1, wherein the elastic contact piece is connected to at least one of the second connection terminals of the second substrate while the elastic contact piece is elastically bent and deformed.

4. The electronic component according to claim 2, wherein:

the locking part is made of an electrically conductive material, and the second substrate includes a ground pad on a part thereof, the ground pad being configured to electrically connect to the locking part.

5. The electronic component according to claim 1, wherein the first connection terminals and the second connection terminals include a terminal for power supply.

6. The electronic component according to claim 1, wherein:

the first substrate further includes a first board-to-board connector adjacent to the first connection terminals on the first surface of the first substrate, the second substrate further includes a second board-to-board connector adjacent to the second connection terminals on the first surface of the second substrate, and the second board-to-board connector is vertically connected to the first board-to-board connector.

7. An electronic device comprising:

an electronic component having:

a first substrate including first connection terminals in an end region on a first surface of the first substrate; and a second substrate including second connection terminals on a first surface of the second substrate, the second connection terminals being at a position corresponding to the first connection terminals, wherein:

the first connection terminals each include a base and an elastic contact piece extending from the base, the elastic contact piece is elastically deformable in a direction in which a tip end portion thereof moves towards and away from the base, and the first connection terminals are electrically connected to the second connection terminals while the first surface of the first substrate is opposed to the first surface of the second substrate, and the second connection terminals are pressed onto the elastic contact pieces.

8. An electronic substrate, comprising:

first connection terminals and a locking part formed on a first surface of the electronic substrate, the locking part being configured to lock to an end edge portion of another substrate, wherein:

the first connection terminals each include a base and an elastic contact piece extending from the base, and the elastic contact piece is elastically deformable in a direction in which a tip end portion thereof moves towards and away from the base, and the elastic contact piece, in an undeformed state, is inclined with respect to the first surface.

* * * * *